US011649701B2

(12) United States Patent
Li et al.

(10) Patent No.: US 11,649,701 B2
(45) Date of Patent: May 16, 2023

(54) MULTI-LEVEL CROSS MINING AREAS SURFACE WELL PATTERN DEPLOYMENT METHOD

(71) Applicant: TAIYUAN UNIVERSITY OF TECHNOLOGY, Shanxi (CN)

(72) Inventors: Zhen Li, Shanxi (CN); Xiaojun Yang, Shanxi (CN); Peng Yang, Shanxi (CN); Zhilong Fang, Shanxi (CN); Jiapeng Zhao, Shanxi (CN); Weichao Fan, Shanxi (CN); Chunwang Zhang, Shanxi (CN); Wenpu Li, Shanxi (CN); Haina Jiang, Shanxi (CN)

(73) Assignee: Taiyuan University of Technology, Shanxi (CN)

( * ) Notice: Subject to any disclaimer, the term of this patent is extended or adjusted under 35 U.S.C. 154(b) by 0 days.

(21) Appl. No.: 17/501,129

(22) Filed: Oct. 14, 2021

(65) Prior Publication Data

US 2022/0251956 A1 Aug. 11, 2022

(30) Foreign Application Priority Data

Feb. 8, 2021 (CN) ..... 202110171048.9

(51) Int. Cl.
*E21B 43/00* (2006.01)
*E21B 43/30* (2006.01)
(Continued)

(52) U.S. Cl.
CPC ..... *E21B 43/006* (2013.01); *E21B 43/2605* (2020.05); *E21B 43/305* (2013.01); *E21F 7/00* (2013.01)

(58) Field of Classification Search
CPC ..... E21B 43/006; E21B 43/305; E21B 43/26; E21B 43/2605; E21F 7/00
See application file for complete search history.

(56) References Cited

U.S. PATENT DOCUMENTS 1,867,758 A * 7/1932 Ranney ..... E21B 43/295 299/2
3,814,480 A * 6/1974 Dahl ..... E21F 7/00 166/308.1
(Continued)

FOREIGN PATENT DOCUMENTS

CN 104563971 A * 4/2015 ..... E21B 43/006
CN 105114038 A * 12/2015
(Continued)

*Primary Examiner* — Jennifer H Gay
(74) *Attorney, Agent, or Firm* — Hunton Andrews Kurth LLP

(57) ABSTRACT

A multi-level cross-district surface well pattern deployment method is provided. Firstly, a horizontal well is drilled from a location on a land surface corresponding to a junction $H_1$ of a district rise coal pillar of the first district $C_1$ in a first level and an upper mine field boundary coal pillar. A multilateral well is drilled from a location on the land surface corresponding to a junction $H_3$ of a level coal pillar between the first and second levels, and the district rise coal pillar of the first district $C_1$ in the first level. Liquid nitrogen is injected for permeability improvement after a gas drainage quantity decreases to 20% of an initial quantity. Gas drainage is repeated multiple times until the drainage quantity of coal bed methane through a gas drainage pipe of the horizontal pipe is reached 3 $m^3$/min.

8 Claims, 4 Drawing Sheets

(51) Int. Cl.
*E21F 7/00* (2006.01)
*E21B 43/26* (2006.01)

(56) References Cited

U.S. PATENT DOCUMENTS

| | | | | | |
|---|---|---|---|---|---|
| 4,093,310 | A * | 6/1978 | Terry | E21B 43/305 | 166/292 |
| 4,303,274 | A * | 12/1981 | Thakur | E21F 7/00 | 166/50 |
| 4,452,489 | A * | 6/1984 | Richards | E21F 7/00 | 166/50 |
| 7,264,049 | B2 * | 9/2007 | Maguire | E21B 43/243 | 166/245 |
| 10,577,891 | B2 * | 3/2020 | Zhai | E21B 43/243 | |
| 2006/0213658 | A1 * | 9/2006 | Maguire | E21B 43/30 | 166/308.4 |
| 2017/0175489 | A1 * | 6/2017 | Zhai | E21B 17/02 | |
| 2022/0251956 | A1 * | 8/2022 | Li | E21F 7/00 | |

FOREIGN PATENT DOCUMENTS

| | | | | | |
|---|---|---|---|---|---|
| CN | 105971563 | A * | 9/2016 | E21B 43/006 | |
| CN | 105971563 | A | 9/2016 | | |
| CN | 106089290 | A * | 11/2016 | | |
| CN | 108331558 | A * | 7/2018 | E21B 43/006 | |
| CN | 110617047 | B * | 6/2021 | E21B 43/006 | |
| CN | 113266314 | A * | 8/2021 | | |
| CN | 114607319 | A * | 6/2022 | | |

* cited by examiner

MULTI-LEVEL CROSS MINING AREAS SURFACE WELL PATTERN DEPLOYMENT METHOD

CROSS REFERENCE TO RELATED APPLICATION

This patent application claims the benefit and priority of Chinese Patent Application No. 202110171048.9, entitled "Multi-level Cross Mining Areas Surface Well Pattern Deployment Method" filed on Feb. 8, 2021, the disclosure of which is incorporated by reference herein in its entirety as part of the present application.

TECHNICAL FIELD

The present disclosure relates to a multi-level cross mining areas surface well pattern deployment method, which belongs to the technical field of mining in mining areas.

BACKGROUND ART

There are numerous residual mining areas in China due to long-term high intensity mining. The methane gas, which is a hazardous gas, may cause great damage. In addition, the greenhouse effect caused by the methane gas may be about 25 to 72 times that caused by carbon dioxide. The methane gas in residual mining areas may diffuse to the atmosphere through poorly sealed wellheads and even land surface fissures to aggravate the greenhouse effect. The methane gas is a clean and high-quality energy source and chemical raw material. As a clean energy source, the methane gas can be collected to improve the energy structure in China, and thus prevented from emission to the atmosphere to aggravate the greenhouse effect.

At present, drainage of the methane gas from abandoned goafs is mainly directed to that with a single working face, and gas drainage from a plurality of old gob areas cannot be achieved. Chinese patent No. CN105971563A has disclosed a method of drainage of coal bed methane from a composite abandoned goaf formed by bottom pillar supported mining. The method significantly contributes to drainage of methane gas from a composite abandoned goaf through a horizontal well. However, the method disclosed in the above patent can only be used for combined gas drainage from maximum two residual mining areas and cannot achieve low-cost high-efficiency combined drainage of coal bed methane from dozens of residual mining areas within a whole of the mine field. There is currently no well pattern deployment method for surface drainage of coal bed methane from up to dozens of residual mining areas under multilevel cross residual mining areas condition within the whole world.

In fact, when multiple coal beds are apart from one another by a particular distance, thin middle coal beds cannot be mined by using current mining and extracting techniques, resulting in the problems of difficult overall development and combined gas drainage of middle thin coal beds and up to dozens of residual mining areas within a whole of the mine field. Therefore, there is an urgent need for a cost-optimal and most-efficient deployment method of a surface well pattern on a mine scale.

SUMMARY

The embodiments aim to provide a multi-level cross mining areas surface well pattern deployment method. A method of cooperative drainage of coal bed methane from multiple horizontal abandoned goafs is proposed from the perspectives of maximum development and utilization of coal bed methane resources and costs, so that the cooperative drainage of coal bed methane from a plurality of top and bottom abandoned goafs and a whole abandoned middle coal bed is realized.

The present disclosure provides the well pattern deployment method, which includes the following steps:

(1) dividing a mine field of a coal mine, based on geological exploration data of the coal mine, into multiple stages according to an elevation in parallel to a strike of the mine field; subdividing each of the multiple stages in a strike of each of the multiple stages into multiple mining areas each having an independent production system; drilling a first horizontal well from a first location on a land surface, wherein the first location is directly above a junction $H_1$ of a district rise coal pillar in a first mining area $C_1$ of the multiple mining areas in a first stage of the multiple stages and an upper mine field boundary coal pillar, with a first horizontal section of the first horizontal well being drilled in a middle coal bed and extending to a junction $H_2$ of a stage coal pillar between the first stage and a second stage of the multiple stages and a left mine field boundary coal pillar; drilling a multilateral well from a second location on the land surface, wherein the second location is directly above a junction $H_3$ of the stage coal pillar between the first and second stages, and the district rise coal pillar in the first mining area $C_1$ in the first stage, with a vertical cavity well being arranged in a main borehole of the multilateral well, a second horizontal well being arranged in a branch borehole, and a second horizontal section being drilled in the middle coal bed and extending to a junction $H_4$ of a district coal pillar between the first mining area $C_1$ and the second mining area $C_2$ of the multiple mining areas in the first stage, and the upper mine field boundary coal pillar:

1) wherein the vertical section of the first horizontal well is 30 m away from a boundary of the first mining area; the deflection point is determined by geological conditions of the well, a depth of the well, and used equipment and process; a first one of the surface ends is divided into the pipe for gas drainage of the first horizontal well and a nitrogen injection pipe of the first horizontal well by a first three-way pipe, and wherein the first gas drainage pipe valve of the first horizontal well is disposed on one side of the pipe for gas drainage of the first horizontal well, and the nitrogen injection pipe valve of the first horizontal well is disposed on one side of the nitrogen injection pipe of the first horizontal well; and 2) wherein the vertical well section of the multilateral well is located in a middle of the stage coal pillar between the first and second stages; a deflection point of the second horizontal well arranged in the branch borehole is determined by geological conditions of the well, a depth of the well, and used equipment and process; a second one of the surface ends is divided into the pipe for gas drainage of the multilateral well and a nitrogen injection pipe of the multilateral well by a second three-way pipe, and wherein the second gas drainage pipe valve of the multilateral well is disposed on one side of the pipe for gas drainage of the multilateral well, and the nitrogen injection pipe valve of the multilateral well is disposed on one side of the nitrogen injection pipe of the multilateral well;

(2) opening a first gas drainage pipe valve at a first surface end of the first horizontal well and a second gas drainage pipe valve at a second surface end of the multilateral well to allow simultaneous drainage of coal bed methane from a plurality of goafs on two sides of the district rise coal pillar through pipes for gas drainage, and recording drainage quantities $Q_1$ and $Q_2$ of the coal bed methane through the first horizontal well and the multilateral well per unit time at this time;

(3) stopping gas drainage through the first horizontal well and closing the first gas drainage pipe valve of the first horizontal well when a drainage quantity of the coal bed methane through the first horizontal well per unit time decreases to 20% of $Q_1$; opening a nitrogen injection pipe valve of the first horizontal well to inject prepared liquid nitrogen into a first heat-insulating frost-cracking resistant steel pipe continuously and circularly by using a first anti-freezing circulating pump, and pressing the liquid nitrogen through small holes in a sleeve of the first horizontal section into coal and rock mass for fracturing; recovering nitrogen 12 hours later, and closing the nitrogen injection pipe valve of the first horizontal well; opening the first gas drainage pipe valve of the first horizontal well to allow drainage of the coal bed methane through the pipe for gas drainage of the first horizontal well again, and recording a drainage quantity $Q_3$ of the coal bed methane per unit time in the first horizontal well at this time;

stopping gas drainage through the multilateral well and closing the second gas drainage pipe valve of the multilateral well when the drainage quantity of the coal bed methane in the multilateral well per unit time decreases to 20% of $Q_2$; opening a nitrogen injection pipe valve of the multilateral well to inject prepared liquid nitrogen into a second heat-insulating frost-cracking resistant steel pipe continuously and circularly by using a second anti-freezing circulating pump, and pressing the liquid nitrogen through small holes in a sleeve of the second horizontal section into the coal and rock mass for fracturing; recovering the nitrogen 12 hours later, and closing the nitrogen injection pipe valve of the multilateral well; opening the second gas drainage pipe valve of the multilateral well to allow drainage of the coal bed methane through the pipe for gas drainage of the multilateral well again, and recording a drainage quantity $Q_4$ of the coal bed methane per unit time in the multilateral well at this time;

(4) stopping gas drainage through the first horizontal well and closing the first gas drainage pipe valve of the first horizontal well when the drainage quantity of the coal bed methane per unit time decreases to 20% of $Q_3$; and stopping gas drainage through the multilateral well and closing the second gas drainage pipe valve of the multilateral well when the drainage quantity of the coal bed methane per unit time decreases to 20% of $Q_4$;

(5) sealing a borehole of the first horizontal well and the branch borehole of the multilateral well, reselecting a deflection point from a vertical section of the first horizontal well in the middle coal bed by using a directional drilling technique, drilling a third horizontal section to communicate with the vertical cavity well of the multilateral well, with the third horizontal section being drilled to slope down at an included angle of 5° to 10° with respect to a horizontal direction, and lowering a water draining pipe from a wellhead of the multilateral well;

(6) opening the first gas drainage pipe valve of the first horizontal well to allow drainage of the coal bed methane through the pipe for gas drainage of the first horizontal well, and draining mine water from the middle coal bed through the water draining pipe of the multilateral well; and (7) closing the first gas drainage pipe valve of the first horizontal well and stopping drainage of the coal bed methane when the drainage quantity of the coal bed methane per unit time decreases to 3 $m^3$/min.

In the above solution, the first horizontal section of the first horizontal well and the second horizontal section of the multilateral well may be drilled in the middle coal bed, and when projected upwards and downwards, the first and second horizontal sections obliquely traverses all the goafs in the first mining area of the first stage.

In the above solution, the vertical well section of the multilateral well may be located in the middle of the stage coal pillar between the first and second stages. The vertical section of the first horizontal well may be 30 m away from a boundary of the first mining area. The deflection point may be determined by the geological conditions of the well, a depth of the well, and used equipment and process. And a first selected deflection point of the first horizontal well may be 90 m apart from a reselected deflection point of the first horizontal well.

In the above solution, the borehole of the first horizontal well and the branch borehole of the multilateral well may be sealed after the first horizontal section of the first horizontal well and the second horizontal section of the multilateral well may be stopped from gas drainage, so that coal bed methane may be prevented from emission during gas drainage through the third horizontal section.

In the above solution, after the drainage of the coal bed methane from the first mining area $C_1$ of the first stage through the first horizontal well and the multilateral well may be finished, a branch borehole of the multilateral well may be rearranged for drilling a horizontal section to a third mining area $C_3$ of the multiple mining areas of the second stage. And boreholes drilled by the multilateral well may be arranged similarly in the second mining area $C_2$ of the first stage and the third mining area $C_3$ of the second stage, thus forming a surface well pattern for drainage of the coal bed methane within a whole of the mine field.

In the above solution, the arrangement is not limited to two stages and four mining areas within the mine field. The mine field may be divided into several stages according to a particular elevation in parallel strike, and each stage may be subdivided into multiple mining areas.

The embodiments have the following advantages.

Form the perspective of drainage of coal bed methane resources within a whole of the mine field, taking into consideration of all residual mining areas in different stages of multilevel and a whole abandoned middle coal bed, an innovative surface well pattern deployment method is provided. The method effectively solves the problem of drainage of the coal bed methane from up to dozens of residual mining areas and abandoned coal of middle coal beds under multilevel cross residual mining area condition within the whole of the mine field. The surface well pattern deployment within the whole of the mine field is achieved through arrangement of a gas drainage system in each mining area. The drainage of the coal bed methane from all residual mining areas (40-60 residual mining areas) and abandoned coal beds in an entire well can be realized through multiple wells within a short time and at low costs. Therefore, the gas drainage efficiency is greatly improved. A cost optimal and most efficient surface well pattern deployment method is realized on a mine scale.

Figure 1:
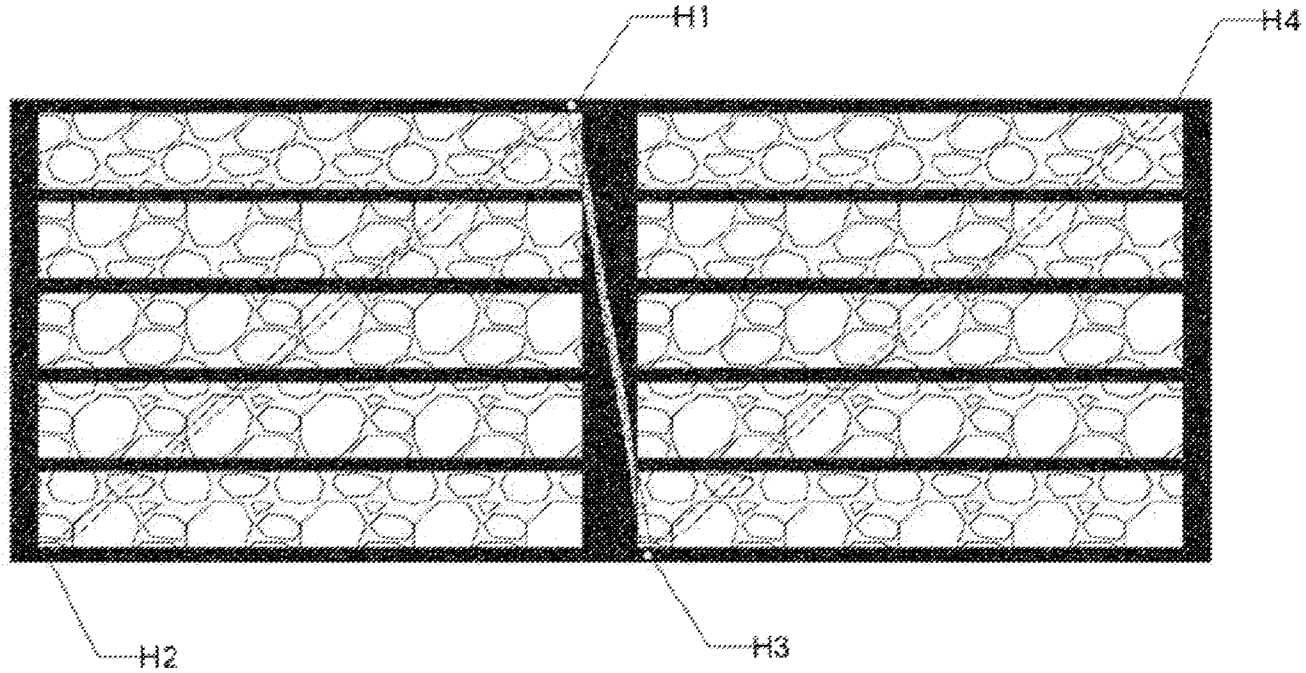
FIG. 1 is a top view of drainage of coal bed methane according to an embodiment of the present disclosure.

List of the reference characters: 1 first horizontal well; 2 multilateral well; 3 pipe for gas drainage; 4 nitrogen injection pipe; 5 first gas drainage pipe valve of first horizontal well; 6 nitrogen injection pipe valve of first horizontal well; 7 second gas drainage pipe valve of multilateral well; 8 nitrogen injection pipe valve of multilateral well; 9 sealing section; 10 sealing device; 11 middle coal bed; 12 mine field boundary coal pillar; 13 upper goaf; 14 lower goaf; 15 district rise coal pillar; 16 first horizontal section; 17 second horizontal section; 18 third horizontal section; 19 stage coal pillar; 20 district coal pillar; 21 first stage; 22 second stage; 23 first deflection point; and 24 second deflection point.

DETAILED DESCRIPTION OF THE EMBODIMENTS

The present disclosure is further illustrated by the following embodiment, but is not limited thereto.

Embodiment 1

Figure 2:
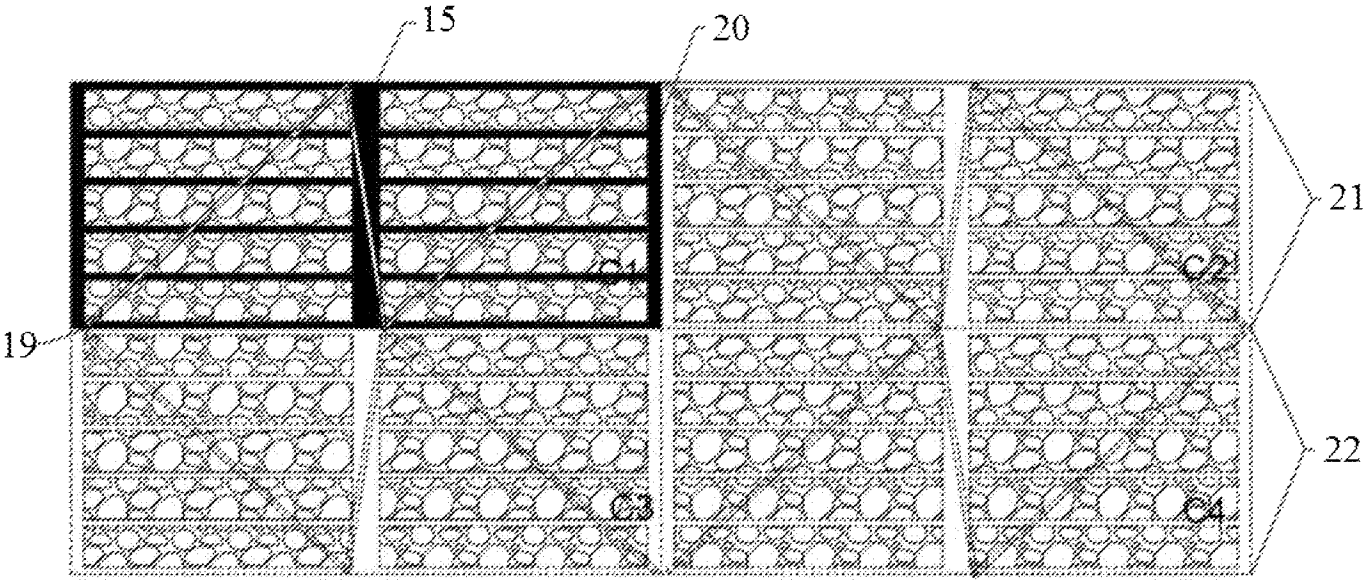
FIG. 2 is a top view of work continuation of drainage of the coal bed methane at a lower stage according to an embodiment of the present disclosure.
Figure 3:
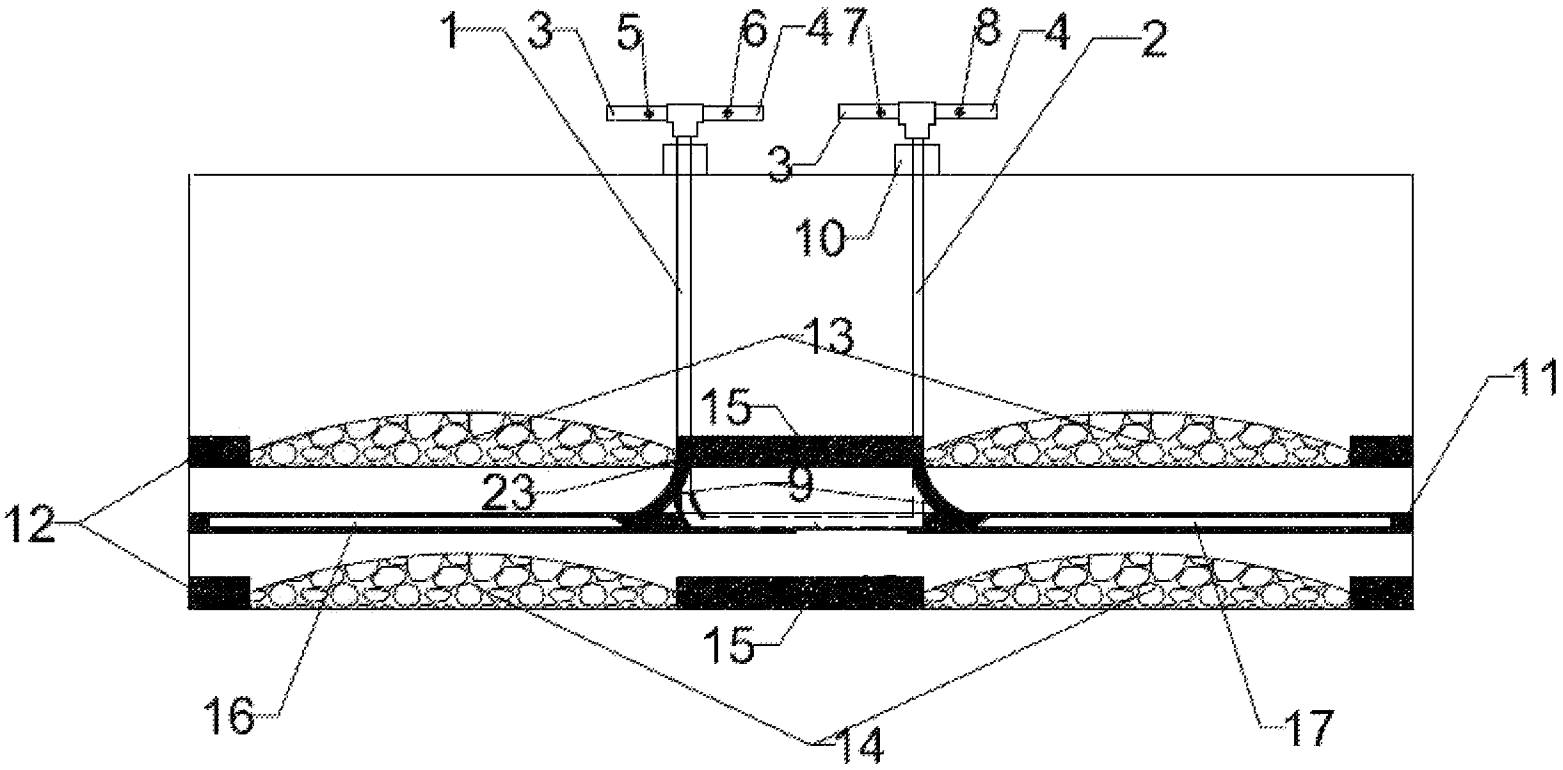
FIG. 3 is a front view of drainage of the coal bed methane according to an embodiment of the present disclosure.
Figure 4:
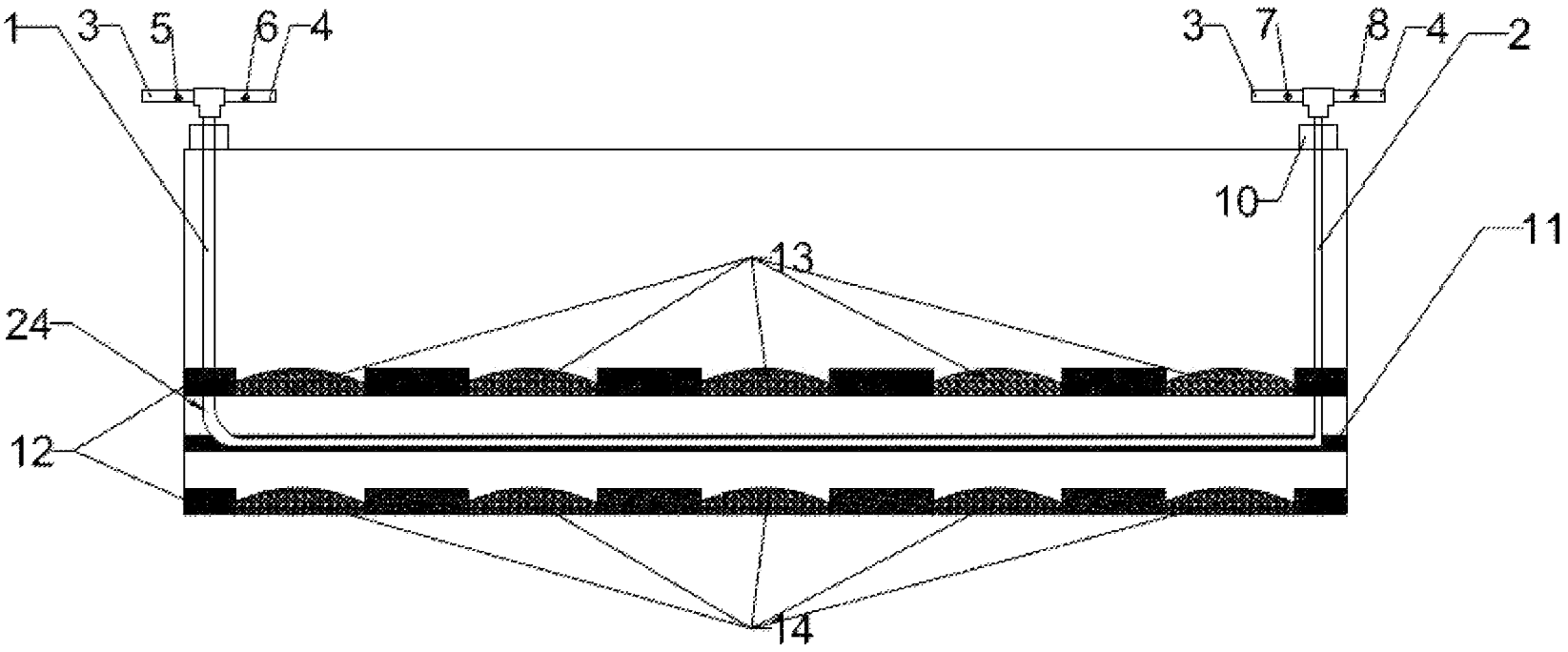
FIG. 4 is a left view of FIG. 3.

With reference to FIG. 1 to FIG. 4, the specific implementation steps of a multi-level cross mining areas surface well pattern deployment method are described below.

In step (1), based on geological exploration data of a coal mine, a mine field is divided into two stages according to a particular elevation in parallel to a strike of the mine field, and each stage is subdivided in a strike of each stage into two mining areas each having an independent production system. A first horizontal well 1 is drilled from a first location on a land surface, the first location is directly above a junction $H_1$ of a district rise coal pillar 15 in the first mining area $C_1$ of the two mining areas in a first stage of the two stages and an upper mine field boundary coal pillar 12. A first horizontal section 16 of the first horizontal well is drilled in a middle coal bed and extended to a junction $H_2$ of a stage coal pillar 19 between the first stage and a second stage of the two stages and a left mine field boundary coal pillar. A multilateral well 2 is drilled from a second location on a land surface, the second location is directly above a junction $H_3$ of the stage coal pillar 19 between the first and second stages, and the district rise coal pillar 15 in the first mining area $C_1$ in the first stage. A vertical cavity well is arranged in a main borehole of the multilateral well, while a second horizontal well are arranged in a branch borehole. A second horizontal section 17 is drilled in the middle coal bed and extended to a junction $H_4$ of a district coal pillar 20 between the first mining area $C_1$ and the second mining area $C_2$ of the two mining areas in the first stage, and the upper mine field boundary coal pillar.

A vertical section of the first horizontal well is 30 m away from the boundary of the first mining area, and a first deflection point 23 is 60 m away from a top of the middle coal bed.

Each surface end is divided into a pipe for gas drainage and a nitrogen injection pipe by three-way pipes. A first gas drainage pipe valve 5 of the first horizontal well is disposed on one side of the gas drainage pipe branch of the first horizontal well 1, while a nitrogen injection pipe valve 6 of the first horizontal well is disposed on one side of the nitrogen injection pipe branch. A second gas drainage pipe valve 7 of the multilateral well is disposed on one side of the gas drainage pipe branch of the multilateral well 2, while a nitrogen injection pipe valve 8 of the multilateral well is disposed on one side of the nitrogen injection pipe branch.

In step (2), the first gas drainage pipe valve 5 of the first horizontal well and the second gas drainage pipe valve 7 of the multilateral well at the surface ends are opened to allow simultaneous drainage of coal bed methane from a plurality of goafs on two sides of the district rise coal pillar 15 through pipes for gas drainage. Gas drainage quantities $Q_1$ and $Q_2$ of the coal bed methane through the first horizontal well 1 and the multilateral well 2 per unit time at this time are recorded.

In step (3), gas drainage through the first horizontal well is stopped and the first gas drainage pipe valve 5 of the first horizontal well is closed when a drainage quantity of the coal bed methane through the first horizontal well per unit time decreased to 20% of $Q_1$. The nitrogen injection pipe valve 6 of the first horizontal well is opened, and prepared liquid nitrogen is injected into a heat-insulating and frost-cracking resistant steel pipe continuously and circularly by using an anti-freezing circulating pump. The liquid nitrogen is pressed through small holes in a sleeve of the first horizontal section 16 into coal and rock mass for fracturing. The nitrogen is recovered 12 hours later, and the nitrogen injection pipe valve 6 of the first horizontal well is closed. The first gas drainage pipe valve 5 of the first horizontal well is opened to allow drainage of coal bed methane through the pipe for gas drainage of the first horizontal well again. And the drainage quantity $Q_3$ of the coal bed methane per unit time in the first horizontal well at this time is recorded.

Gas drainage through the multilateral well is stopped and the second gas drainage pipe valve 7 of the multilateral well is closed when the drainage quantity of the coal bed methane per unit time decreased to 20% of $Q_2$. The nitrogen injection pipe valve 8 of the multilateral well is opened, and prepared liquid nitrogen is injected into a heat-insulating frost-cracking resistant steel pipe continuously and circularly by using an anti-freezing circulating pump. The liquid nitrogen is pressed through small holes in a sleeve of the second horizontal section 17 into the coal and rock mass for fracturing. The nitrogen is recovered 12 hours later, and the nitrogen injection pipe valve 8 of the multilateral well is closed. The second gas drainage pipe valve 7 of the multilateral well is opened to allow drainage of coal bed methane through the pipe for gas drainage of the multilateral well again, and the drainage quantity $Q_4$ of coal bed methane per unit time in the multilateral well at this time is recorded.

In step (4), gas drainage through the first horizontal well 1 is stopped and the first gas drainage pipe valve 5 of the first horizontal well is closed when the drainage quantity of the coal bed methane per unit time decreased to 20% of $Q_3$. And gas drainage through the multilateral well 2 is stopped and the second gas drainage pipe valve 7 of the multilateral well is closed when the drainage quantity of coal bed methane per unit time decreased to 20% of $Q_4$.

In step (5), the borehole of the first horizontal well 1 and the branch borehole of the multilateral well 2 are sealed. A kick off point is selected again from the vertical section of the first horizontal well in the middle coal bed 11 by using a directional drilling technique. A second deflection point 24 is located at the vertical section of the first horizontal well and 90 m away from the first deflection point. A third horizontal section 18 is drilled to communicate with the vertical cavity well of the multilateral well. The third horizontal section 18 is drilled to slope down at an included angle of 5° to 10° with respect to the horizontal direction. A water draining pipe is lowered from a wellhead of the multilateral well 2.

In step (6), the first gas drainage pipe valve 5 of the first horizontal well is opened to allow drainage of the coal bed methane through the pipe for gas drainage of the first horizontal well 1, and mine water is drained from the middle coal bed through the water draining pipe of the multilateral well 2.

In step (7), the first gas drainage pipe valve 5 of the first horizontal well is closed, and drainage of the coal bed methane is stopped when the drainage quantity of the coal bed methane per unit time decreased to 3 $m^3$/min.

What is claimed is:

1. A well pattern deployment method, comprising the following steps:

dividing a mine field of a coal mine, based on geological exploration data of the coal mine, into a plurality of stages according to an elevation in parallel to a strike of the mine field; subdividing each of the plurality of stages in a strike of each of the plurality of stages into a plurality of mining areas each having an independent production system; drilling a first horizontal well from a first location on a land surface, wherein the first location is directly above a junction $H_1$ of a district rise coal pillar in a first mining area $C_1$ of the plurality of mining areas in a first stage of the plurality of stages and an upper mine field boundary coal pillar, with a first horizontal section of the first horizontal well being drilled in a middle coal bed and extending to a junction $H_2$ of a stage coal pillar between the first stage and a second stage of the plurality of stages and a left mine field boundary coal pillar; drilling a multilateral well from a second location on the land surface, wherein the second location is directly above a junction $H_3$ of the stage coal pillar between the first stage and the second stage, and the district rise coal pillar in the first mining area $C_1$ in the first stage, with a vertical cavity well being arranged in a main borehole of the multilateral well, a second horizontal well being arranged in a branch borehole, and a second horizontal section being drilled in the middle coal bed and extending to a junction $H_4$ of a district coal pillar between the first mining area $C_1$ and a second mining area $C_2$ of the plurality of mining areas in the first stage, and the upper mine field boundary coal pillar;

opening a first gas drainage pipe valve at a first surface end of the first horizontal well and a second gas drainage pipe valve at a second surface end of the multilateral well to allow simultaneous drainage of coal bed methane from a plurality of goafs on two sides of the district rise coal pillar through pipes for gas drainage, and recording gas drainage quantities $Q_1$ and $Q_2$ of the coal bed methane through the first horizontal well and the multilateral well per unit time at this time;

stopping gas drainage through the first horizontal well and closing the first gas drainage pipe valve of the first horizontal well when a drainage quantity of the coal bed methane through the first horizontal well per unit time decreases to 20% of $Q_1$;

opening a nitrogen injection pipe valve of the first horizontal well to inject liquid nitrogen into a first heat-insulating frost-cracking resistant steel pipe continuously and circularly by using a first anti-freezing circulating pump, and pressing the liquid nitrogen through small holes in a sleeve of the first horizontal section into coal and rock mass for fracturing; recovering nitrogen 12 hours later, and closing the nitrogen injection pipe valve of the first horizontal well;

opening the first gas drainage pipe valve of the first horizontal well to allow drainage of the coal bed methane through a pipe for gas drainage of the first horizontal well again, and recording a drainage quantity $Q_3$ of the coal bed methane per unit time in the first horizontal well at this time;

stopping gas drainage through the multilateral well and closing the second gas drainage pipe valve of the multilateral well when the drainage quantity of the coal bed methane in the multilateral well per unit time decreases to 20% of $Q_2$; opening a nitrogen injection pipe valve of the multilateral well to inject liquid nitrogen into a second heat-insulating frost-cracking resistant steel pipe continuously and circularly by using a second anti-freezing circulating pump, and pressing the liquid nitrogen through small holes in a sleeve of the second horizontal section into the coal and rock mass for fracturing;

recovering the nitrogen 12 hours later, and closing the nitrogen injection pipe valve of the multilateral well;

opening the second gas drainage pipe valve of the multilateral well to allow drainage of the coal bed methane through a pipe for gas drainage of the multilateral well again, and recording a drainage quantity $Q_4$ of the coal bed methane per unit time in the multilateral well at this time;

stopping gas drainage through the first horizontal well and closing the first gas drainage pipe valve of the first horizontal well when the drainage quantity of the coal bed methane per unit time decreases to 20% of $Q_3$; and stopping gas drainage through the multilateral well and closing the second gas drainage pipe valve of the multilateral well when the drainage quantity of the coal bed methane per unit time decreases to 20% of $Q_4$;

sealing a borehole of the first horizontal well and the branch borehole of the multilateral well, reselecting a deflection point from a vertical section of the first horizontal well in the middle coal bed by using a directional drilling technique, drilling a third horizontal section to communicate with the vertical cavity well of the multilateral well, with the third horizontal section being drilled to slope down at an included angle of 5° to 10° with respect to a horizontal direction, and lowering a water draining pipe from a wellhead of the multilateral well;

opening the first gas drainage pipe valve of the first horizontal well to allow drainage of the coal bed methane through the pipe for gas drainage of the first horizontal well, and draining mine water from the middle coal bed through the water draining pipe of the multilateral well; and closing the first gas drainage pipe valve of the first horizontal well and stopping drainage of the coal bed methane when the drainage quantity of the coal bed methane per unit time decreases to 3 $m^3$/min.

2. The method according to claim 1, wherein the vertical section of the first horizontal well is 30 m away from a boundary of the first mining area; the deflection point is determined by geological conditions of the well, a depth of the well, and used equipment and process; a first one of the surface ends is divided into the pipe for gas drainage of the first horizontal well and a nitrogen injection pipe of the first horizontal well by a first three-way pipe, and wherein the first gas drainage pipe valve of the first horizontal well is disposed on one side of the pipe for gas drainage of the first horizontal well, and the nitrogen injection pipe valve of the first horizontal well is disposed on one side of the nitrogen injection pipe of the first horizontal well.

3. The method according to claim 1, wherein:

the vertical well section of the multilateral well is located in a middle of the stage coal pillar between the first stage and the second stage;

a deflection point of the second horizontal well arranged in the branch borehole is determined by geological conditions of the well, a depth of the well, and used equipment and process;

a second one of the surface ends is divided into the pipe for gas drainage of the multilateral well and a nitrogen injection pipe of the multilateral well by a second three-way pipe, and the second gas drainage pipe valve of the multilateral well is disposed on one side of the pipe for gas drainage of the multilateral well, and the nitrogen injection pipe valve of the multilateral well is disposed on one side of the nitrogen injection pipe of the multilateral well.

4. The method according to claim 1, wherein:

the first horizontal section of the first horizontal well and the second horizontal section of the multilateral well are drilled in the middle coal bed, and when projected upwards and downwards, the first horizontal section and the second horizontal section obliquely traverse all the goafs in the first mining area of the first stage.

5. The method according to claim 1, wherein the vertical well section of the multilateral well is located in a middle of the stage coal pillar between the first stage and the second stage.

6. The method according to claim 1, wherein a first selected deflection point of the first horizontal well is 90 m apart from a reselected deflection point of the first horizontal well.

7. The method according to claim 1, wherein the borehole of the first horizontal well and the branch borehole of the multilateral well are sealed after the first horizontal section of the first horizontal well and the second horizontal section of the multilateral well are stopped from gas drainage, so that coal bed methane is prevented from emission during gas drainage through the third horizontal section.

8. The method according to claim 1, wherein after the drainage of the coal bed methane from the first mining area $C_1$ of the first stage through the first horizontal well and the multilateral well is finished, a branch borehole of the multilateral well is rearranged for drilling a horizontal section to a third mining area $C_3$ of the plurality of mining areas of the second stage; and boreholes drilled by the multilateral well are arranged similarly in the second mining area $C_2$ of the first stage and the third mining area $C_3$ of the second stage, thus forming a surface well pattern for drainage of the coal bed methane within a whole of the mine field.

* * * * *